US008869640B2

(12) United States Patent
Abe et al.

(10) Patent No.: US 8,869,640 B2
(45) Date of Patent: Oct. 28, 2014

(54) ENGINE STARTER

(75) Inventors: Masami Abe, Chiyoda-ku (JP); Koichiro Kamei, Chiyoda-ku (JP); Kazuhiro Odahara, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 220 days.

(21) Appl. No.: 13/398,412

(22) Filed: Feb. 16, 2012

(65) Prior Publication Data

US 2013/0081514 A1 Apr. 4, 2013

(30) Foreign Application Priority Data

Oct. 4, 2011 (JP) ..... 2011-219733

(51) Int. Cl.
*F02N 11/02* (2006.01)

(52) U.S. Cl.
USPC ..... 74/7 A; 74/7 E

(58) Field of Classification Search
USPC ..... 74/7 R, 7 A, 7 C, 7 E
See application file for complete search history.

(56) References Cited

U.S. PATENT DOCUMENTS 8,302,497 B2 * 11/2012 Niimi et al. ..... 74/7 C
8,428,855 B2 * 4/2013 Okumoto et al. ..... 701/113

FOREIGN PATENT DOCUMENTS

JP 2006-161590 A 6/2006
JP 2006-307680 A 11/2006
JP 2009-138656 A 6/2009

* cited by examiner

*Primary Examiner* — William C Joyce
(74) *Attorney, Agent, or Firm* — Sughrue Mion, PLLC

(57) ABSTRACT

Provided is an engine starter wherein a torsional angle θ1 of a helical spline 4*a* of an output shaft 4 is set in such a way that a reactive force Fp1 of a plunger spring 33, which is operated to a clutch 5, is larger than a propulsive force F, which is operated so as to urge the clutch 5 by a rotational force of the motor 2 in a shaft direction along a helical spline 4*a* of an output shaft 4, before a pinion engaging solenoid 8 is operated. Thereby, it can be prevented that the clutch 5 is urged in the shaft direction, so that it can be prevented without upsizing the engine starter that the pinion 6 is protruded in the shaft direction.

3 Claims, 4 Drawing Sheets

ENGINE STARTER

BACKGROUND OF THE INVENTION

1. Technical Field of the Invention

The present invention relates to an engine starter that restarts an engine when a restart request for the engine is caused.

2. Background Art

Recently, in a car on which an engine is mounted, in order to improve the fuel efficiency of the engine or the like, an idling stop system has been adopted, in which the engine is automatically stopped when an engine output is not required, and the engine is automatically restarted when en engine output is required.

An engine automatic stop/restart device is described in Patent Document 1, which selects one control means from a plurality of control means including a control means, by which a motor is rotated so as to synchronize a rotational velocity of a pinion to a rotational velocity of a ring gear, when a restart request for the engine is caused during the rotational velocity of the engine is reduced until the engine is stopped, and the pinion is extruded and engaged to a ring gear so as to start the cranking of the engine, after a difference between both rotational velocities is reduced, and then restarts the engine.

Although a detailed explanation for an operation means, by which the motor for rotatably driving the pinion and an actuator for engaging the pinion to the ring gear linked to a crank shaft of the engine are individually operated, is not described in this Patent Document 1, it is considered that the engine automatic stop/restart device includes an electromagnet for extruding a pinion and an electromagnetic relay for energizing a motor, which are described, for example, in Patent Document 2.

Moreover, there is a well-known conventional engine starter, in which a pinion stroke and a torsional angle of a helical spline linking portion are set in such a way that a pinion, which is extruded, in conjunction with a clutch, in an opposite direction of a motor, is contacted to an end surface of a ring gear, and then the pinion can be rotated and moved to a position at which the pinion can be engaged to the ring gear, before a motor contactor is closed (for example, refer to Patent Document 3).

CONVENTIONAL ART DOCUMENT

Patent Document

Patent Document 1

Japanese Laid-Open Patent Publication No. 2011-169312 (FIG. 1 and a description for FIG. 1)

Patent Document 2

Japanese Laid-Open Patent Publication No. 2011-94489 (FIG. 1 and a description for FIG. 1)

Patent Document 3

Japanese Laid-Open Patent Publication No. 2006-161590 (FIG. 1 and a description for FIG. 1)

SUMMARY OF THE INVENTION

Problems to be Solved by the Invention

Here, it is considered that a configuration of the starter described in Patent Document 3 is applied to the engine starter described in Patent Document 1, and the durability of a pinion and a ring gear is improved.

However, in the above-described engine starter, if a restart request for an engine is caused and a motor is rotated while an engine rotation velocity is reduced, a rotational force of the motor is transmitted to a clutch and a pinion via a helical spline linking portion, whereby the clutch is extruded in a shaft direction along the helical spline linking portion, and the pinion as well as the clutch is protruded toward a ring gear side.

Therefore, it is feared that the pinion is contacted to the ring gear before the pinion is extruded to a position at which the pinion is engaged to the ring gear, and a noise is caused. Moreover, it is feared that the pinion and the ring gear are worn out by contacting both components with each other, and the durability of the pinion and the ring gear is deteriorated.

In order to solve the above-described problems, a method is considered in which a plunger spring is not easily bent and the clutch is prevented from being protruded toward the ring gear side, by increasing a weight of the plunger spring which presses and biases a plunger for moving the clutch in a shaft direction.

However, when the engine starter is started, the plunger is opposed to the weight of the plunger spring and moved in a shaft direction, whereby the clutch and the pinion are extruded in the shaft direction. Therefore, if the weight of the plunger spring is increased, a pulling force of the plunger, which is necessary to extrude the pinion toward a position at which the pinion is linked to the ring gear, must be increased, when a restart request for the engine is caused.

Therefore, it is required to upsize an electromagnet for extruding the pinion, by which the plunger is moved in the shaft direction, and it is faired that the whole of the engine starter is upsized.

The present invention has been made to solve the above-described problems, and an object of the invention is to prevent a protrusion of a pinion due to a rotation of a motor in an engine starter, without upsizing the whole of the engine starter, in which the pinion is extruded after the motor is rotated, and the pinion is engaged to a ring gear during a rotational velocity of an engine is reduced.

Means for Solving Problems

An engine starter of the present invention includes a motor for generating a rotational force; an output shaft to which the rotational force of the motor is transmitted; a clutch that includes a thrust spline, which is linked to the output shaft via a helical spline provided around an outer circumference of the output shaft, and a cylindrical component provided around the outer circumference of the output shaft in such a way that the cylindrical component can be relatively rotated with respect to the output shaft and can be slid in a shaft direction, and transmits a torque from the thrust spline to the cylindrical component when a rotation in one direction is transmitted from the output shaft to the thrust spline; a pinion that is linked to the cylindrical component via a spline provided around the outer circumference of the cylindrical component, and sustained to the cylindrical component in such a way that the pinion can be moved in the shaft direction; a lever that is integrated to the pinion and extrudes the clutch in the shaft direction; a pinion extruding solenoid that generates an electromagnetic force so as to pull a plunger, and engages the pinion to a ring gear of an engine via the lever which is rotated in conjunction with a movement of the plunger; a plunger spring that biases the plunger toward the lever side; and a motor energizing switch that opens/closes a motor contact provided in a motor energizing circuit, in a state where the pinion extruding solenoid is operated after the motor energizing switch is operated, when the engine is restarted during a time period for reducing a rotational velocity so as to stop the engine, wherein a propulsive force F operated to the clutch is calculated by the following formula (1), when the propulsive force, which is operated so as to extrude the clutch in the shaft direction by the rotational force of the motor, is defined as F, an inertial moment of the clutch is defined as I, an angular velocity at start-up of a rotation of the motor is defined as β, a torsional angle of the helical spline of the output shaft is defined as θ1, and a standard pitch radius of the helical spline of the output shaft is defined as r; moreover, the torsional angle θ1 of the helical spline of the output shaft is defined so as to establish a relationship of the following formula (2), when a reactive force of the plunger spring, which is operated to the clutch, is defined as Fp1, and a lever ratio of the lever is defined as R.

$$F=I\times\beta/(r\times\tan\theta 1) \quad \text{Formula (1)}$$

$$I\times\beta/(r\times\tan\theta 1)<Fp1\times R \quad \text{Formula (2)}$$

Effects of the Invention

According to the present invention, even if a propulsive force F, which extrudes a clutch in a shaft direction via a helical spline provided around an output shaft, is operated by a rotational force of a motor, which is generated by an operation of a motor energizing switch, a reactive force Fp1 of a plunger spring, which is operated to the clutch, can be increased more than the propulsive force F, so that the clutch can be prevented from being extruded in the shaft direction.

Thereby, it can be prevented that a pinion is protruded toward a ring gear side and contacted to the ring gear, so that a noise is reduced. Moreover, the abrasion of the pinion and the ring gear, which is caused by contacting the pinion and the ring gear, can be suppressed, and the durability of the components can be improved.

Furthermore, a relationship of the above-described Formula (2) is established by setting a torsional angle θ1 of the helical spline provided around the output shaft, so that the other coefficient, for example, the reactive force Fp1 of the plunger spring or a lever ratio R of a lever must not be changed. Thereby, the upsizing of a pinion extruding solenoid due to an increment of the reactive force Fp1 of the plunger spring is not caused, and the upsizing of an engine starter due to an increment of the lever ratio R of the lever is not caused, so that the above-described effects can be obtained.

DETAILED DESCRIPTION OF THE PREFERRED EMBODIMENTS

Embodiment 1

Figure 1:
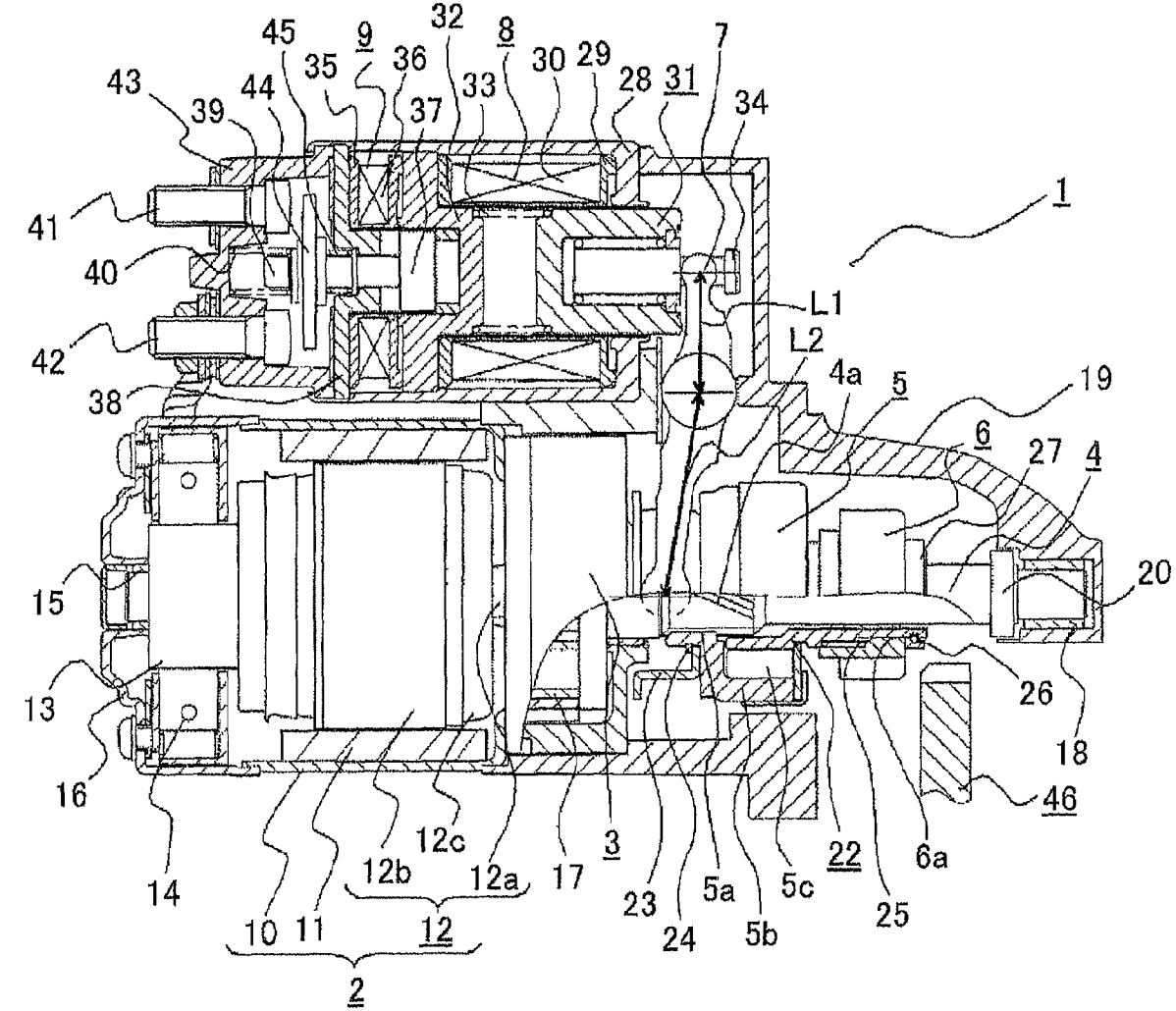
FIG. 1 is a cross-sectional view illustrating an engine starter according to Embodiment 1 of the present invention.
Figure 2:
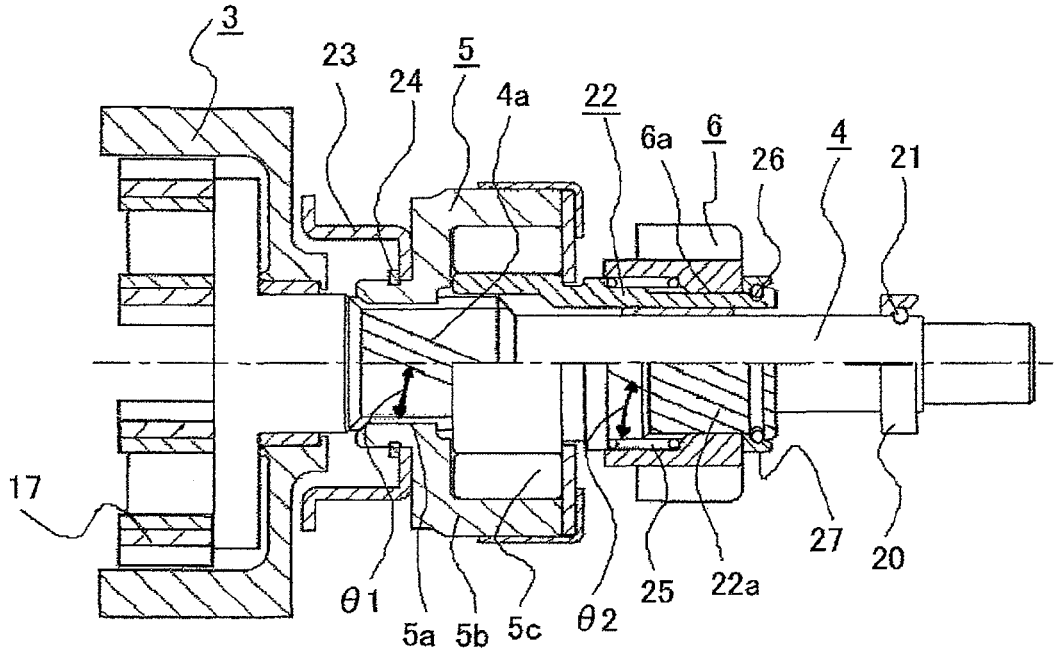
FIG. 2 is a cross-sectional view illustrating a pinion and peripheral components of the pinion in the engine starter in FIG. 1.
Figure 3:
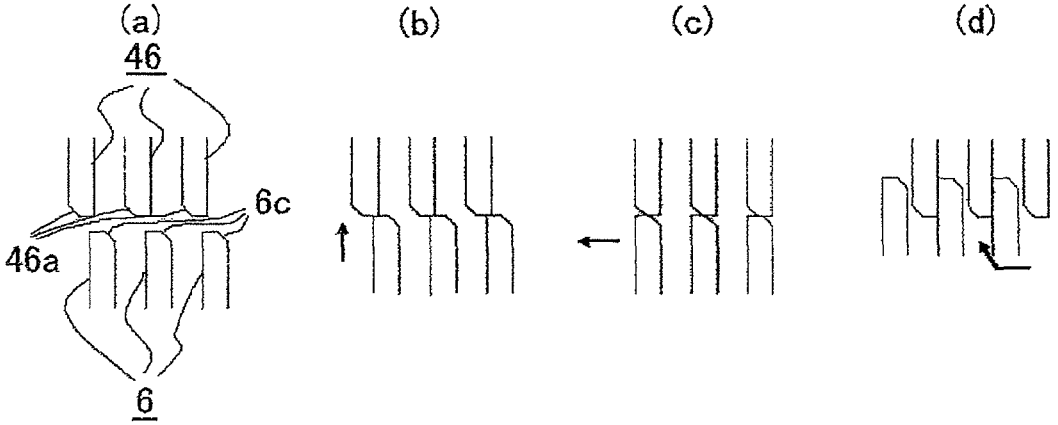
FIG. 3 are explanatory diagrams illustrating operations of the pinion in the engine starter in FIG. 1.

FIG. 1 is a cross-sectional view illustrating an engine starter according to Embodiment 1 of the present invention. FIG. 2 is a cross-sectional view illustrating a pinion and peripheral components of the pinion in the engine starter in FIG. 1. FIG. 3 are explanatory diagrams illustrating operations of the pinion in the engine starter in FIG. 1. Here, reference symbols, which are the same as those in each drawing, refer to the same parts.

In FIG. 1 and FIG. 2, an engine starter 1 includes a motor 2 for generating a rotational force; an output shaft 4 which is rotated by the rotational force transmitted from the motor 2 via a speed reducer 3; a clutch 5 which is linked to the output shaft 4 via a helical spline 4*a* provided around an outer circumference of the output shaft 4; a pinion 6 which is provided in such a way that the pinion 6 is integrated with the clutch 5 and can be moved in a shaft direction (left-right direction in FIG. 1 and FIG. 2) around the outer circumference of the output shaft 4; a pinion extruding solenoid 8 which extrudes the clutch 5 and the pinion 6 in an opposite direction of the motor 2 (right direction in FIG. 1 and FIG. 2) via a lever 7; a motor energizing switch 9 which opens or closes a motor contact (described later) provided in a motor circuit by which an operation current is passed from a battery (not illustrated) through the motor 2; and other components.

The motor 2 is a well-known DC motor, which includes field magnets configured by arranging a plurality of permanent magnets 11 (or magnetic field coils) along an inner circumference of a yoke 10 composing a magnetic circuit; an armature 12 which is configured by winding an armature coil 12*c* around an armature core 12*b* fixed to an armature shaft 12*a* and generates a rotational force of the armature shaft 12*a* by an electromagnetic force which is operated to the armature coil 12*c*; a brush 14 for supplying a battery current to the armature coil 12*c* via a commutator 13; and other components.

In the armature 12, one end portion of the armature shaft 12*a* is sustained to the output shaft 4 in such a way that the armature 12 can be relatively rotated with respect to the output shaft 4, and the other end portion of the armature shaft 12*a* is sustained to a rear bracket 16 via a bearing 15 in such a way that the armature 12 can be rotated.

The speed reducer 3 is a well-known planetary gear reducer in which a plurality of planetary gears 17 engaging to a sun gear (not illustrated) provided on the armature shaft 12*a* are included, and the planetary gears 17 revolve around the sun gear while the planetary gears 17 rotate.

The output shaft 4 is arranged in the same axial direction of the armature shaft 12*a* via the speed reducer 3, and an end portion at an opposite side of the motor 2 is rotatably sustained to a front bracket 19 via a bearing 18.

A stopper 20, which has a ring shape in the same axial direction of the output shaft 4, is locked at a tip of the output shaft 4 near the front bracket 19 side by a retaining ring 21, and a front movement of a cylindrical component 22 (described later) is regulated by the stopper 20.

The clutch 5 includes a thrust spline 5*b* as an outer portion, on which a helical spline linking portion 5*a* provided at an inner circumference of the clutch 5 is linked to the helical spline 4*a* provided around the outer circumference of the output shaft 4; the cylindrical component 22 as an inner portion, which is provided around the outer circumference of the output shaft 4 and fitted to the output shaft 4 in such a way that the cylindrical component 22 can be relatively rotated with respect to the output shaft 4 and can be slid in the shaft direction; a roller 5*c* which transmits a torque from the thrust spline 5*b* to the cylindrical component 22 when a rotation in one direction is transmitted from the output shaft 4 to the thrust spline 5*b*; and other components. A torsional angle of the helical spline 4*a* provided around the output shaft 4 is defined as an angle θ1 in a reverse rotational direction of the motor 2.

At the motor 2 side of the clutch 5, a space collar 23, which is a linking component (described later) to the lever 7, is fitted to the clutch 5 by a retaining ring 24.

In the pinion 6, a helical spline linking portion 6*a* provided at an inner circumference of the pinion 6 is linked to a helical spline 22*a* provided around an outer circumference of the cylindrical component 22 which is protruded in a front direction of the clutch 5 (opposite direction of the motor 2), and the pinion 6 is sustained to the cylindrical component 22 in such a way that the pinion 6 can be moved a predefined distance in the shaft direction. A torsional angle of the helical spline 22*a* provided at the cylindrical component 22 is defined as an angle θ2 in the reverse rotational direction of the motor 2, and the angle θ2 is larger than the angle θ1.

A pinion spring 25 is disposed between a step surface provided at the inner circumference side of the pinion 6 and a step surface provided at the outer circumference side of the cylindrical component 22. The pinion 6 is biased in a tip direction of the cylindrical component 22 (opposite direction of the clutch 5) by receiving a reactive force of the pinion spring 25, and a tip surface of the pinion 6 is contacted to a pinion stopper 27, which is attached to a tip of the cylindrical component 22 by a stopping ring 26, whereby the pinion 6 is positioned.

Hereinafter, configurations of the pinion extruding solenoid 8 and the motor energizing switch 9 will be briefly explained.

The pinion extruding solenoid 8 and the motor energizing switch 9 are arranged in series in the shaft direction and integrally configured, and both components are fixed to the front bracket 19 in parallel with the motor 2.

The pinion extruding solenoid 8 includes a case 28; a solenoid coil 30 which is wound around a bobbin 29 made from a resin and is housed inside the case 28; a plunger 31 which is made from a magnetic material and disposed at an inner circumference side of the solenoid coil 30; a stationary core 32 which is made from a magnetic material and fitted to the case 28 so as to oppose the plunger 31; a plunger spring 33 which is disposed between the stationary core 32 and the plunger 31 so as to bias the plunger 31 toward the lever 7 side; and other components.

The plunger 31 includes a hook 34 which is pulled in a shaft direction by an electromagnetic force generated by the solenoid coil 30 and transmits a movement of the hook 34 in the shaft direction to one end portion of the lever 7.

Moreover, the other end portion of the lever 7 is linked to the space collar 23, and the lever 7 is rotatably sustained in the front bracket 19.

Here, a length from a rotational center of the lever 7 to the hook 34 is defined as "L1", and a length from the rotational center to the clutch 5 is defined as "L2".

The motor energizing switch 9 and the pinion extruding solenoid 8 share the movable core 32, and the motor energizing switch 9 is integrated to the pinion extruding solenoid 8. The motor energizing switch 9 includes the above-described movable core 32 and case 28, and further includes a coil 36 which is made from a conductive material and wound around a bobbin 35 which is made from a resin; a plunger 37 which is made from a magnetic material and composes a magnetic circuit; a stationary core 38 which is made from a magnetic material and composes a magnetic circuit; a rod 39 linked to the plunger 37; a return spring 40 which biases the rod 39 and the plunger 37 in an opposite direction of the stationary core 38; a contact cover 43 in which a battery terminal 41 and a motor terminal 42, which compose one side of motor contacts, are mounted; a movable contact 44 which is linked to the rod 39 and composes the other side of the motor contacts; and a contact spring 45 which biases the movable contact 44.

Hereinafter, operations of the engine starter 1 will be explained.

When a restart request for the engine is caused in a rotational velocity range, in which a rotational velocity of the engine is relatively high, during the rotational velocity of the engine is reduced so as to automatically stop the engine, a rotational velocity of a ring gear 46 is also relatively high, so that it is judged by an ECU (electronic control unit) that the pinion 6 cannot be smoothly engaged to the ring gear 46, if a rotational velocity of the pinion 6 is not synchronized to the rotational velocity of the ring gear 46.

At this time, a current is passed from the battery to the motor energizing switch 9 in accordance with a command of the ECU. By passing a current through the coil 36 of the motor energizing switch 9, the plunger 37 is pulled toward the contact cover 43, and the rod 39 and the movable contact 44 are moved toward the contact cover 43 in conjunction with the plunger 37. When the movable contact 44 is contacted to the battery terminal 41 and the motor terminal 42, a main contact becomes a close condition. As a result, a current is passed from the battery to the motor 2 so as to generate a rotational force, and the rotational force of the motor 2 is transmitted to the output shaft 4.

After the rotational velocity of the pinion 6, which is rotated in conjunction with the output shaft 4, is synchronized to the rotational velocity of the ring gear 46 so as to reduce a difference between both rotational velocities, a current is passed through the pinion extruding solenoid 8 by a command of the ECU.

Thereby, the plunger 31 is pulled to the stationary core 32 while the plunger spring 33 is bent by the plunger 31, and then one end portion of the lever 7 linked to the hook 34 is rotated, and the other end portion of the lever 7 extrudes the space collar 23 in the shaft direction. Thus, the pinion 6 as well as the clutch 5 is extruded in the shaft direction, and the pinion 6 is engaged to the ring gear 46 in a rotational state, whereby the cranking of the engine is started, and the engine is restarted. The progress of operations is described later, in which the pinion 6, which is extruded in the shaft direction by the pinion extruding solenoid 8, is contacted and engaged to an end surface of the ring gear 46.

In addition, the rotational velocity of the ring gear 46 can be detected by a crank angle sensor or the like, and the rotational velocity of the pinion 6 can be detected by a rotational velocity sensor or the like.

Hereinafter, characteristics of the engine starter 1 according to Embodiment 1 will be explained.

When a restart request for the engine is caused during the rotational velocity of the engine is reduced so as to automatically stop the engine, a current is passed from the battery to the coil 36 of the motor energizing switch 9 as described above, and the energization of the motor 2 is started. As a result, a rotational force is generated, and the rotational force is transmitted to the output shaft 4.

At this time, the energization of the pinion extruding solenoid 8 according to a command of the ECU is not performed, and the pinion 6 intends to be rotated without being extruded in the shaft direction. However, when the rotational force is transmitted to the output shaft 4, the clutch 5 including the thrust spline 5*b*, which is linked to the output shaft 4 via the helical spline 4*a* of the output shaft 4, receives the rotational force of the motor 2, and a propulsive force is operated in a direction where the clutch 5 is extruded in the shaft direction.

Hereinafter, when a propulsive force, which is operated so as to extrude the clutch 5 in the shaft direction by the rotational force of the motor 2, is defined as "F", an inertial moment of the clutch 5 is defined as "I", an angular velocity at start-up of a rotation of the motor 2 is defined as "β", and a standard pitch radius of the helical spline 4*a* of the output shaft 4 is defined as "r", the propulsive force F operated to the clutch 5 is calculated by the following formula (1).

$$F=I\times\beta/(r\times\tan\theta 1) \quad \text{Formula (1)}$$

Moreover, when a reactive force of the plunger spring 33, which is operated to the clutch 5, is defined as "Fp1", and a lever ratio of the lever 7 is defined as "R" (R=L1/L2), the torsional angle θ1 of the helical spline 4*a* of the output shaft 4 is defined in such a way that a relationship of the following formula (2) is established, in other words, a relationship of the following formula (3) is established.

$$F<Fp1\times R \quad \text{Formula (2)}$$

$$I\times\beta/(r\times\tan\theta 1)<Fp1\times R \quad \text{Formula (3)}$$

By composing the engine starter as described above, even if the propulsive force F is operated so as to extrude the clutch 5 in the shaft direction, the reactive force Fp1 of the plunger spring 33, which is operated to the clutch 5, can be increased more than the propulsive force F, so that the clutch 5 can be prevented from being extruded in the shaft direction. Thereby, it can be prevented that the pinion 6 is protruded and contacted to the ring gear 46, so that a noise is reduced. Moreover, the abrasion of the pinion 6 and the ring gear 46, which is caused by the above-described contacting, can be suppressed, and the durability of these components can be improved.

Furthermore, the relationship of the formula (3) is established by setting the torsional angle θ1 of the helical spline 4*a* of the output shaft 4, so that the other coefficient, for example, the reactive force Fp1 of the plunger spring 33 or the lever ratio R of the lever 7 must not be changed. Thereby, the upsizing of the pinion extruding solenoid 8 due to an increment of the reactive force Fp1 of the plunger spring 33 is not caused, and the upsizing of the engine starter 1 due to an increment of the lever ratio R of the lever 7 is not caused, so that the above-described effects can be obtained.

Hereinafter, the progress of operations, in which the pinion 6 is extruded in the shaft direction by the pinion extruding solenoid 8 and engaged to the ring gear 46, will be explained in reference to FIG. 3. In addition, a rotational direction of the pinion 6 (motor 2) and the ring gear 46 is defined as a left direction in FIG. 3.

A beveled portion 6*c* is formed at a corner portion of the pinion 6, at which an end surface for contacting the pinion 6 to the ring gear 46 is crossed to a gear surface at a reverse rotational direction side of the motor 2. In a similar way, a beveled portion 46*a* is formed at a corner portion of the ring gear 46, at which an end surface for contacting the ring gear 46 to the pinion 6 is crossed to a gear surface at a rotational direction side of the motor 2.

In a state indicated in FIG. 3 (*a*), when a restart request for the engine is caused, the motor energizing switch 9 is operated, and a rotational force is generated in the motor 2, whereby the pinion 6 is rotated without being extruded.

In a state indicated in FIG. 3 (*b*), the pinion extruding solenoid 8 is operated after the pinion 6 is rotated, and the pinion 6 as well as the clutch 5 is extruded in an allow direction illustrated in FIG. 3 (*b*). At this time, the pinion 6 is contacted to the end surface of the ring gear 46 in a rotational state while the pinion 6 is moved in the reverse rotational direction of the motor 2 (right direction in FIG. 3) along the helical spline 4*a* of the output shaft 4.

In a state indicated in FIG. 3 (*c*), in which the pinion 6 is contacted to the ring gear 46, the cylindrical component 22 is more extruded while the pinion spring 25 is bent. At this time, the pinion 6 is pushed back, in accordance with a distance for which the cylindrical component 22 is extruded (in accordance with a stroke distance for which the pinion spring 25 can be bent), on the cylindrical component 22 along the helical spline 22*a* of the cylindrical component 22. In this state, the torsional angles are set in such a way that the torsional angle θ2 of the helical spline 22*a* of the cylindrical component 22 is larger than the torsional angle θ1 of the helical spline 4*a* of the output shaft 4, so that the pinion 6 is moved, in accordance with an angle difference (θ2−θ1) between both torsional angles, along the end surface of the ring gear 46 in the rotational direction of the motor 2.

In a state indicated in FIG. 3 (*d*), when the pinion 6 is rotated and moved to a position at which the pinion 6 can be engaged to the ring gear 46, the beveled portion 6*c* of the pinion 6 is moved along the beveled portion 46*a* of the ring gear 46, and an engagement of the pinion 6 and the ring gear 46 is started. When the engagement of both components is terminated, the rotational force is transmitted from the pinion 6 to the ring gear 46.

In the engine starter 1 according to Embodiment 1, which is configured as described above, even when the pinion extruding solenoid 8 is operated, but the pinion 6 cannot be early engaged to the ring gear 46 by a reason that the pinion 6 and the ring gear 46 are worn out due to aged deterioration, or dust or the like adheres to the contact surface of the pinion 6 or the ring gear 46, the pinion 6 can be moved, in accordance with the angle difference (θ2−θ1) between both the torsional angles, from a position, at which the pinion 6 is firstly contacted to the contact surface of the ring gear 46, toward the rotational direction of the motor 2.

Therefore, a distance, for which the pinion 6 is moved along the end surface of the ring gear 46 in the rotational direction of the motor 2 before the pinion 6 is engaged to the ring gear 46 by the rotational force of the motor 2, can be reduced, and the abrasion of the pinion 6 and the ring gear 46 can be suppressed.

Moreover, an elapsed time for engaging the pinion 6 to the ring gear 46 by the rotational force of the motor 2 can be reduced, so that a rotational velocity of the pinion 6 at time of the engaging can be reduced, whereby an impact force at time of the engaging can be reduced. Thereby, it can be suppressed that the durability of the pinion 6 and the ring gear 46 is deteriorated.

Furthermore, a collision sound at time of the engaging can be reduced, so that a noise can be suppressed.

Embodiment 2

Figure 4:
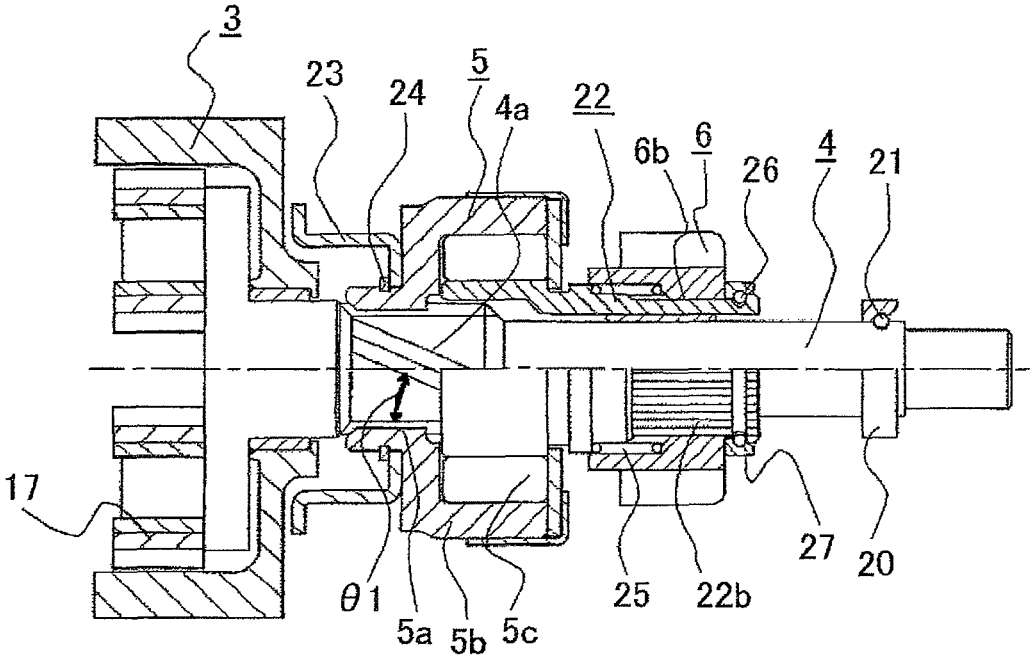
FIG. 4 is a cross-sectional view illustrating a pinion and peripheral components of the pinion in an engine starter according to Embodiment 2 of the present invention.
Figure 5:
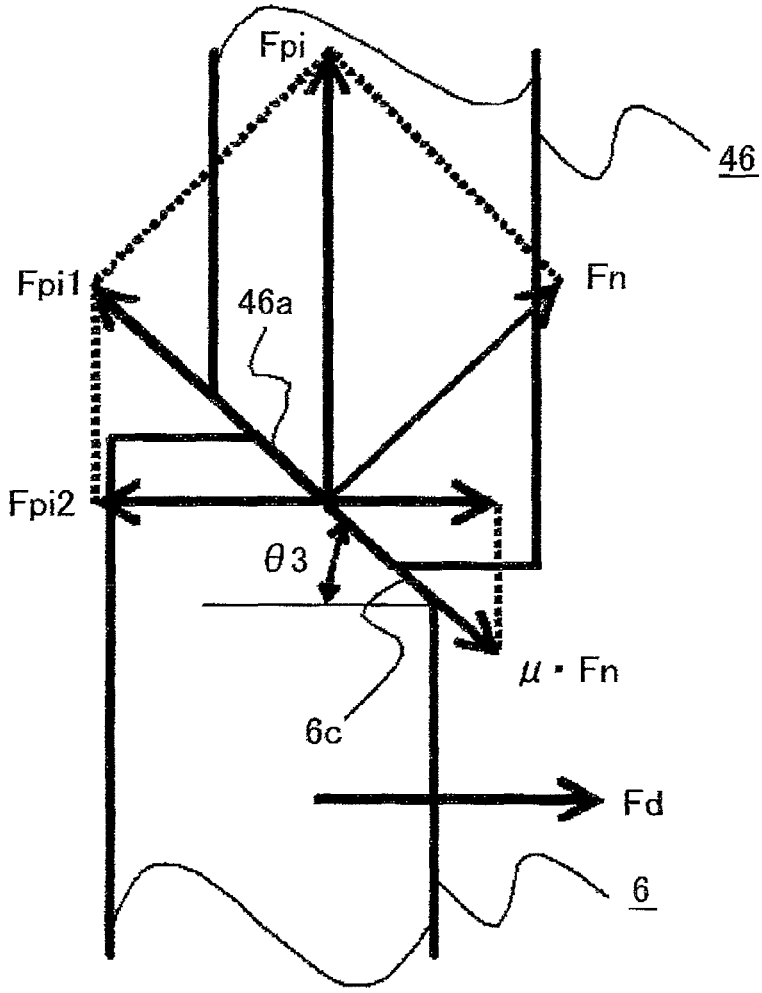
FIG. 5 is a relationship diagram illustrating force conditions in a state where the pinion in the engine starter in FIG. 4 is contacted to a ring gear at a beveled portion.

Hereinafter, Embodiment 2 of the present invention will be explained in reference to FIG. 4 and FIG. 5. FIG. 4 is a cross-sectional view illustrating a pinion and peripheral components of the pinion in an engine starter according to Embodiment 2 of the present invention. FIG. 5 is a relationship diagram illustrating force conditions in a state where the pinion in the engine starter in FIG. 4 is contacted to a ring gear at a beveled portion.

In above-described Embodiment 1, the helical spline 22*a* is provided around the outer circumference of the cylindrical component 22, and the pinion 6 includes the helical spline linking portion 6*a* which is linked to the helical spline 22*a*, whereas, in this Embodiment 2, a linear spline 22*b* is provided around the outer circumference of the cylindrical component 22 as illustrated in FIG. 4, and the pinion 6 includes a linear spline linking portion 6*b* which is linked to the linear spline 22*b*.

In addition, the other components are configured in a similar way described in Embodiment 1.

In a case of the engine starter 1 according to Embodiment 1, the clutch 5 receives the rotational force of the motor 2, and the propulsive force F is operated in a direction where the clutch 5 is extruded in the shaft direction. In a similar way, the pinion 6 also receives the rotational force of the motor 2, and a propulsive force is operated in a direction where the pinion 6 is extruded in the shaft direction.

Thus, when the pinion 6 is engaged to the ring gear 46 so as to transmit the rotational force, an impact force is continuously applied to the pinion stopper 27, by which a movement of the pinion 6 in the shaft direction is regulated, in accordance with the above-described propulsive force operated to the pinion 6, so that it is feared that a durability of the pinion stopper 27 is deteriorated.

In Embodiment 2, the linear spline linking portion 6*b* of the pinion 6 is linked to the linear spline 22*b* of the cylindrical component 22, so that the propulsive force is not operated in a direction where the pinion 6 is extruded in the shaft direction, even if the pinion 6 receives the rotational force of the motor 2. Therefore, the impact force applied to the pinion stopper 27 can be reduced, and a durability of the engine starter 1 can be improved.

Hereinafter, the engine starter 1 according to Embodiment 2 will be explained in reference to FIG. 5, in a case where the beveled portion 6*c* of the pinion 6 is contacted to the beveled portion 46*a* of the ring gear 46, when the pinion 6, which is extruded in the shaft direction by the pinion extruding solenoid 8, is engaged to the ring gear 46 in a rotational state.

In addition, as illustrated in FIG. 5, the beveled portion 6*c* of the pinion 6 and the beveled portion 46*a* of the ring gear 46 are formed in such a way that each of the beveled portions has a bevel angle θ3.

Even when the beveled portion 6*c* of the pinion 6, which is extruded in the shaft direction by the pinion extruding solenoid 8, is contacted to the beveled portion 46*a* of the ring gear 46, the cylindrical component 22 is more extruded while the pinion spring 25 is bent as described above, so that a reactive force "Fpi" of the pinion spring 25 is operated to the pinion 6 in the shaft direction. A vertical opposing force "Fn", which is operated in accordance with the reactive force Fpi, is calculated by the following formula (4).

$$Fn = Fpi \times \cos\theta 3 \quad \text{Formula (4)}$$

When a frictional coefficient of a portion, at which the beveled portion 6*c* of the pinion 6 and the beveled portion 46*a* of the ring gear 46 are contacted, is defined as "μ", a frictional force "Ff" in a reverse rotational direction of the motor 2, which is operated to the contact portion of the pinion 6 and the ring gear 46, is calculated by the following formula (5) and formula (6).

$$Ff = \mu \times Fn \times \cos\theta 3 \quad \text{Formula (5)}$$

$$= \mu \times Fpi \times \cos^2\theta 3 \quad \text{Formula (6)}$$

Meanwhile, the reactive force Fpi of the pinion spring 25 is also operated to the contact portion, and a force "Fpi1", which is operated, in accordance with the reactive force Fpi, in a direction of both beveled portions 6*c* and 46*a* (engagement direction), is calculated by the following formula (7).

$$Fpi1 = Fpi \times \sin\theta 3 \quad \text{Formula (7)}$$

Moreover, a force "Fpi2" in the rotational direction of the motor 2, which is operated, in accordance with the force Fpi1, in the engagement direction, is calculated by the following formula (8) and formula (9).

$$Fpi2 = Fpi1 \times \cos\theta 3 \quad \text{Formula (8)}$$

$$= Fpi \times \sin\theta 3 \times \cos\theta 3 \quad \text{Formula (9)}$$

Moreover, a force "Fd", which is operated in accordance with an idle running torque of the clutch 5 in the reverse rotational direction of the motor 2, is also operated at the contact portion.

Here, in the engine starter 1 according to Embodiment 2, the reactive force Fpi of the pinion spring 25 and the bevel angle θ3, which is set for the beveled portion 6*c* of the pinion 6 and the beveled portion 46*a* of the ring gear 46, are defined in such a way that a relationship of the following formula (10) is established, in other words, a relationship of the following formula (11) is established.

$$Ff + Fd < Fpi2 \quad \text{Formula (10)}$$

$$\mu \times Fpi \times \cos^2\theta 3 + Fd < Fpi \times \sin\theta 3 \times \cos\theta 3 \quad \text{Formula (11)}$$

According to the above-described configuration of the engine starter 1, the force Fpi2, which is operated, in accordance with the reactive force Fpi of the pinion spring 25, in the rotational direction of the motor 2, is larger than a summation of the force Ff, which is operated, in accordance with the frictional force operated to the contact portion of the pinion 6 and the ring gear 46, in the reverse rotational direction of the motor 2, and the force Fd, which is operated, in accordance with an idle running torque of the clutch 5, in the reverse rotational direction of the motor 2.

Therefore, when the beveled portion 6*c* of the pinion 6 and the beveled portion 46*a* of the ring gear 46 are contacted with each other, the pinion 6 is idled in the rotational direction of the motor 2 via the cylindrical component 22 which is an inner component of the clutch 5, and the pinion 6 can be engaged to the ring gear 46.

Therefore, in this case, the pinion 6 can be more early engaged to the ring gear 46 in comparison with a case where the pinion 6 is engaged to the ring gear 46 by only the rotational force of the motor 2. Therefore, when it is started that the rotational force of the motor 2 is transmitted to the ring gear 46 via the pinion 6, a contact area of a tooth surface, at which the pinion 6 and the ring gear 46 are engaged with each other, can be more increased, so that a pressure toward the tooth surface at the contact portion can be reduced, whereby the deterioration of the durability of the pinion 6 and the ring gear 46 can be suppressed.

Moreover, an impact force at time of the engaging can be more reduced in comparison with a case where the pinion 6 is engaged to the ring gear 46 by only the rotational force of the motor 2, so that the deterioration of the durability of the pinion 6 and the ring gear 46 can be suppressed.

In addition, the reactive force Fpi of the pinion spring 25 can be defined in accordance with a spring constant "k" and the above-described stroke distance for which the pinion spring 25 can be bent.

Moreover, although it is described that the engine starter according to the present invention performs the operations in which the motor is rotated, and then the pinion 6 is engaged to the ring gear 46 while an engine rotation velocity is reduced, an engine starter for performing at least the above-described operations may be used. For example, an engine starter may be used, which performs a different operation, in accordance with the timing of the restart request for the engine, such as an operation in which the pinion 6 is extruded so as to be engage to the ring gear 46 after a restart request for the engine is caused, and then the cranking of the engine is started by rotating the motor 2.

Furthermore, although the engine starter in each of the embodiments is explained as a both-end support type engine starter in which a tip of the output shaft 4 is rotatably sustained to the front bracket 19 via the bearing 18, the engine starter of the present invention is not limited by this specification. For example, an engine starter having a one-end support structure (so-called overhang structure), in which the tip of the output shaft 4 is not sustained by the front bracket 19, may be used. In other cases, even when the present invention is applied to an engine starter having a structure in which the motor 2 and the pinion 6 are arranged in parallel in the shaft direction, and both components are linked by an idle gear, the same effect can be obtained.

In a similar way, the present invention can be also applied to an engine starter belonging to a device type in which the speed reducer 3 is not included (direct drive type), or to an engine starter having a structure in which the pinion extruding solenoid 8 and the motor energizing switch 9 are individually arranged in parallel in the shaft direction.

Furthermore, the present invention can be also applied to an engine starter having a structure in which the movement of the clutch 5 in the shaft direction is regulated, without using the stopper 20, by applying a well-known technology in which a protrude portion for retaining the thrust spline 5*b* is added to a tip of a lead wire of the helical spline 4*a* of the output shaft 4, or to a tip of a lead wire of the helical spline linking portion 5*a* of the thrust spline 5*b*.

What is claimed is:

1. An engine starter comprising:

a motor for generating a rotational force;

an output shaft to which the rotational force of the motor is transmitted;

a clutch that includes a thrust spline, which is linked to the output shaft via a helical spline provided around an outer circumference of the output shaft, and a cylindrical component provided around the outer circumference of the output shaft in such a way that the cylindrical component can be relatively rotated with respect to the output shaft and can be slid in a shaft direction, and transmits a torque from the thrust spline to the cylindrical component when a rotation in one direction is transmitted from the output shaft to the thrust spline;

a pinion that is linked to the cylindrical component via a spline provided around the outer circumference of the cylindrical component, and sustained to the cylindrical component in such a way that the pinion can be moved in the shaft direction;

a lever that is integrated to the pinion and urges the clutch in the shaft direction;

a pinion engaging-solenoid that generates an electromagnetic force so as to pull a plunger, and engages the pinion to a ring gear of an engine via the lever which is rotated in conjunction with a movement of the plunger;

a plunger spring that biases the plunger toward the lever side; and a motor energizing switch that opens/closes a motor contact provided in a motor energizing circuit, in a state where the pinion extruding solenoid is operated after the motor energizing switch is operated, when the engine is restarted during a time period for reducing a rotational velocity so as to stop the engine, wherein a propulsive force F operated to the clutch is calculated by the following formula (1), $F=I\times\beta/(r\times\tan\theta 1)$, when the propulsive force, which is operated so as to urge the clutch in the shaft direction by the rotational force of the motor, is defined as F, an inertial moment of the clutch is defined as I, an angular velocity at start-up of a rotation of the motor is defined as β, a torsional angle of the helical spline of the output shaft is defined as θ1, and a standard pitch radius of the helical spline of the output shaft is defined as r; moreover, the torsional angle θ1 of the helical spline of the output shaft is defined so as to establish a relationship of the following formula (2), $I\times\beta/(r\times\tan\theta 1)<Fp1\times R$, when a reactive force of the plunger spring, which is operated to the clutch, is defined as Fp1, and a lever ratio of the lever is defined as R, wherein a pinion spring, which is disposed between the cylindrical component and the pinion so as to store a reactive force in a shaft direction between both parts, is further included;

a beveled portion of the pinion is formed at a corner portion at which an end surface for contacting the pinion to the ring gear is crossed to a gear surface at a reverse rotational direction side of the motor;

a beveled portion of the ring gear is formed at a corner portion at which an end surface for contacting the ring gear to the pinion is crossed to a gear surface at a rotational direction side of the motor; and a reactive force Fpi of the pinion spring and a bevel angle θ3 of both beveled portions are defined so as to establish a relationship of the following formula (4), $\mu\times Fpi\times\cos 2\theta 3+Fd<Fpi\times\sin\theta 3\times\cos\theta 3$, when the beveled portion of the pinion, which is urged by the lever, is contacted to the beveled portion of the ring gear, and the reactive force of the pinion spring, which is operated to the pinion, is defined as Fpi, the bevel angle of both the beveled portions is defined as θ3, a frictional coefficient of both the beveled portions is defined as μ, and a force, which is operated in accordance with an idle running torque of the clutch in a reverse rotational direction, is defined as Fd.

2. An engine starter according to claim 1, wherein the spline of the cylindrical component is a helical spline, and the torsional angle θ1 and a torsional angle θ2 are defined so as to establish a relationship of the following formula (3), $\theta 1<\theta 2$, when the torsional angle of the helical spline is defined as θ2.

3. An engine starter according to claim 1, wherein the spline of the cylindrical component is a linear spline.

* * * * *